US005447421A

United States Patent [19]

Malfit

[11] Patent Number: 5,447,421

[45] Date of Patent: Sep. 5, 1995

[54] HYDRAULIC GENERATOR-RECEIVER FOR POWER TRANSMISSION, COMPRISING AN IMPROVED HYDRAULIC BALANCING

[76] Inventor: Jean Malfit, 7, rue de Chapotte Le Napoleon, Tournon 07300, France

[21] Appl. No.: 153,980

[22] Filed: Nov. 18, 1993

[30] Foreign Application Priority Data

Nov. 26, 1992 [FR] France ..... 92 14676

[51] Int. Cl.[6] ..... F01C 21/10

[52] U.S. Cl. ..... 418/71; 418/132

[58] Field of Search ..... 418/132, 71, 75, 201.1

[56] References Cited

U.S. PATENT DOCUMENTS 4,781,552 11/1988 Malfit ..... 418/132

5,028,221 7/1991 Malfit ..... 418/132

5,178,528 1/1993 Malfit ..... 418/132

*Primary Examiner*—Richard A. Bertsch

*Assistant Examiner*—Charles G. Freay

*Attorney, Agent, or Firm*—Pollock, Vande Sande & Priddy

[57] ABSTRACT

In an hydraulic generator-receiver for power transmission, with an improved hydraulic balancing, balancing of the axial force of the driving gear is effected by varying the value of the surface of the permanent high pressure zone, so that this variation causes an application of the high pressure on a surface of one of the side plates, either greater, or lower, while the value of the permanent high pressure zone has no influence on the other side plate. In addition, the inter-sector zone is incorporated in the sectors of the envelope to balance the tangential force of the driving gear.

9 Claims, 9 Drawing Sheets

ϕD+ΔD
ϕD
6
54
60
201
37
45
34
100
207
58
49
21
10
3
9
40
45a
45'a
45''a
305
306
20
37'
37''
45'
45''
60'
60''

HYDRAULIC GENERATOR-RECEIVER FOR POWER TRANSMISSION, COMPRISING AN IMPROVED HYDRAULIC BALANCING

FIELD OF THE INVENTION

The present invention relates to an hydraulic generator-receiver for power transmission of the type described in U.S. Pat. No. 5,178,528.

BACKGROUND OF THE INVENTION

U.S. Pat. No. 5,178,528 discloses an apparatus comprising two gears with helical toothing coupled inside a stator, the driven gear being free of any mechanical bearing, the driven gear alone is equipped with mechanical bearings as it is unbalanced by an axial force and a tangential force. The stator is in the form of a flexible envelope and two identical flexible side plates turned with respect to each other, cooperating with the envelope and containing the two gears with which they ensure a lateral seal by their identical inner face. The stator further comprises at least one opening for admission of a liquid at low pressure and an opening for delivery of a liquid at high pressure.

The flexible envelope is externally subjected to centripetal pressure which allows it to ensure sealing on the apices of the teeth of the gears with helical toothing located in the stator. The forces of hydrostatic compensation on the side plates and on the envelope come from the pressure of the zone permanently under high generated or received pressure, as well as from the pressure prevailing in sectors of hydrostatic balancing compensation, respectively of the envelope and of the side plates.

The rounded-V-shaped sectors are diametrically opposed in the area of the mesh point of the gears. The holes issue into sector 60' when they are provided into the side plates. The arcuate sectors are located around the gears respectively diametrically opposed with respect to the sectors. It is to be noted that, within the side plate, the sectors are face to face with respect to the sectors, respectively, of the side plate. The sectors are supplied via channels. Rigid lids cover the side plates, while a likewise rigid body surrounds the envelope.

Internal hydraulic balancing is ensured by a hydraulic winding comprising rotor conduits in the gears and stator conduits in the side plates and the envelope. The rotor circuits in the gears are constituted by groups of conduits, diametrically opposite on the commutation circle and parallel (or inclined by the value of the helix angle) to the axis of the gears, and radial conduits connecting the conduits opposite $\pi$ to form an H. The stator circuits are constituted by grooves and conduits for connection to the troughs of teeth and to the sectors of hydrostatic compensation.

In this way, during rotation of the gears, the winding places the sectors opposite $\pi$ in HP or LP relation. Of course, such connection does not exist between the meshing zone and those respectively in which are created hydraulic bearings which give two opposite forces on the gears and ensuring meshing thereof without clearance at mesh point of the gears 3.

A metal insert has been incorporated in each side plate in order to avoid collapse of the side plates when the grooves thereof are at low pressure. The covers and the body comprise respective projections directed towards the inside of the apparatus and adapted to penetrate in the depressions of the side plates and the envelope, respectively. These projections serve as anti-extrusion devices of joints defining the sectors by hydrostatic compensation, respectively. The permanent total pressure zone includes the whole surface defined outside these joints and closed on the axis of the gears by the joints.

The embodiment according to prior art does not ensure satisfactory axial balancing of the driving gear. In fact, although the action of the radial hydraulic bearings ensures radial equilibrium, the axial balancing of the driving gear by the hydrostatic compensations on the side plates at the mesh point ensures only local balancing of the axial component at that point bringing about more considerable local wear of the side plate subjected to the axial component of the driving gear and therefore a precarious long-term resistance. The general axial balancing of the driving gear is not ensured due to the axial components at each end of the assembly constituted by each of the high pressure balancing sectors and by the two adjacent elements of the zone always at high pressure, resulting from the hydrostatic compensations on the side plates.

Furthermore, the equilibrium of the tangential components on the driving gear is ensured by the reactions of the mechanical bearings. These reactions, by the wear that they provoke, are detrimental in the long run to the internal equilibrium of the generator-receiver with one driven satellite gear, generator-receiver with helical or double-helical toothing, and it is possible to replace them by a hydrostatic balancing which is partial in the two directions of rotation and total for one direction of rotation (most frequent case for small cubic capacities which require only one satellite gear). This device may therefore also be applied to the generator-receivers with gears with double-helical toothing, this toothing being similar to a simple helical toothing when the apparatus presents two gears.

FIGS. 1 to 5 illustrate the different hydraulic and mechanical forces acting on the driving face of the driving gear referenced corresponding to the active part of the driving face at high pressure, the generator-receiver functioning as generator, the driving gear comprising a left-hand helix and rotating in anti-clockwise direction.

The driven gear is itself totally balanced since the faces of each tooth space are subjected to the same tangential, radial and axial, mechanical and hydraulic forces.

On the driving gear are applied:

the radial force FR (FIG. 1)

the axial force FA (FIG. 2)

the tangential force FT (FIG. 2).

The tangential force FT is defined from the power transmitted and from the speed of rotation, the forces FR and FA resulting via FN and FX both from the angle $\delta$ of real pressure and the angle $\beta$ which is the complement of the helix angle $\alpha$ defined in U.S. Pat. No. 5,028,291.

FIG. 2 illustrates the tangential force FT which determines the axial force FA.

FIGS. 3 and 4 illustrate the orientation of the axial force FA to which the driving gear is subjected, while the couple MFA resulting from force FA is illustrated in FIG. 5.

The latter figure illustrates the balance of the forces and couples to be balanced on the driving gear of a generator-receiver with one satellite gear, these gears being contained in the body, in the clockwise or counter-clockwise direction of rotation. The illustrations of the right-hand part of FIG. 5 refer to the driving gear. The axial force FA applied to the latter is perpendicular to its lateral face gear, while the force FT acts in the same plane perpendicularly to the axis passing through the centers of the two gears.

This force acts from point 305 towards diametrally opposite point 306 or inversely, depending on the direction of rotation. The couple MFA is balanced by the reactions of the bearings of the driving gear.

The present invention is designed to overcome these drawbacks and to allow axial and tangential hydrostatic balancing of the driving gear.

SUMMARY OF THE INVENTION

To that end, in order to effect axial balancing, the value of the surface of the permanent high pressure zone is varied so that an application of the high pressure is produced on a surface of one of the side plates, either greater or lower, the other side plate not being influenced by this surface variation, while, to effect tangential balancing, the surface of the sectors of the envelope adjacent the mesh point is varied, to the detriment of the permanent pressure zone.

BRIEF DESCRIPTION OF THE DRAWINGS

The invention will be more readily understood on reading the following description with reference to the accompanying drawings, in which.

DETAILED DESCRIPTION OF THE DRAWINGS

Referring again to the drawings, no further reference will be made to the demonstration made in the preamble according to FIGS. 1 to 5 and wherein only the driving gear must be balanced, balancing of the driven gear(s) 10 being effected as demonstrated.

Hydrostatic balancing of the force FR by the hydraulic bearings in zones 6 is obtained by a theoretical value of $\frac{1}{2}$ angular tooth pitch, or $\pi/Z$ Z being the number of teeth. This value is sufficient to balance the radial, mechanical and hydrostatic forces in the mesh zone 3. This value of $\frac{1}{2}$ pitch may vary as a function of the conditions of tightness at 3 and of the values of the pressures in the teeth spaces.

The hydrostatic equilibrium of the force FA must allow reversibility, i.e., the change of direction of rotation as generator or as receiver of the apparatus according to the invention. The best solution for an apparatus with one driven gear is to adopt for the two gears a double-helical toothing thanks to which the axial forces FA are naturally balanced between the two $\frac{1}{2}$ helical toothings of opposite inclination of the double-helical toothing.

On the contrary, for a generator-receiver comprising two gears with normal helical toothing, balancing of the axial force FA must be effected as described hereinafter.

Figure 8:
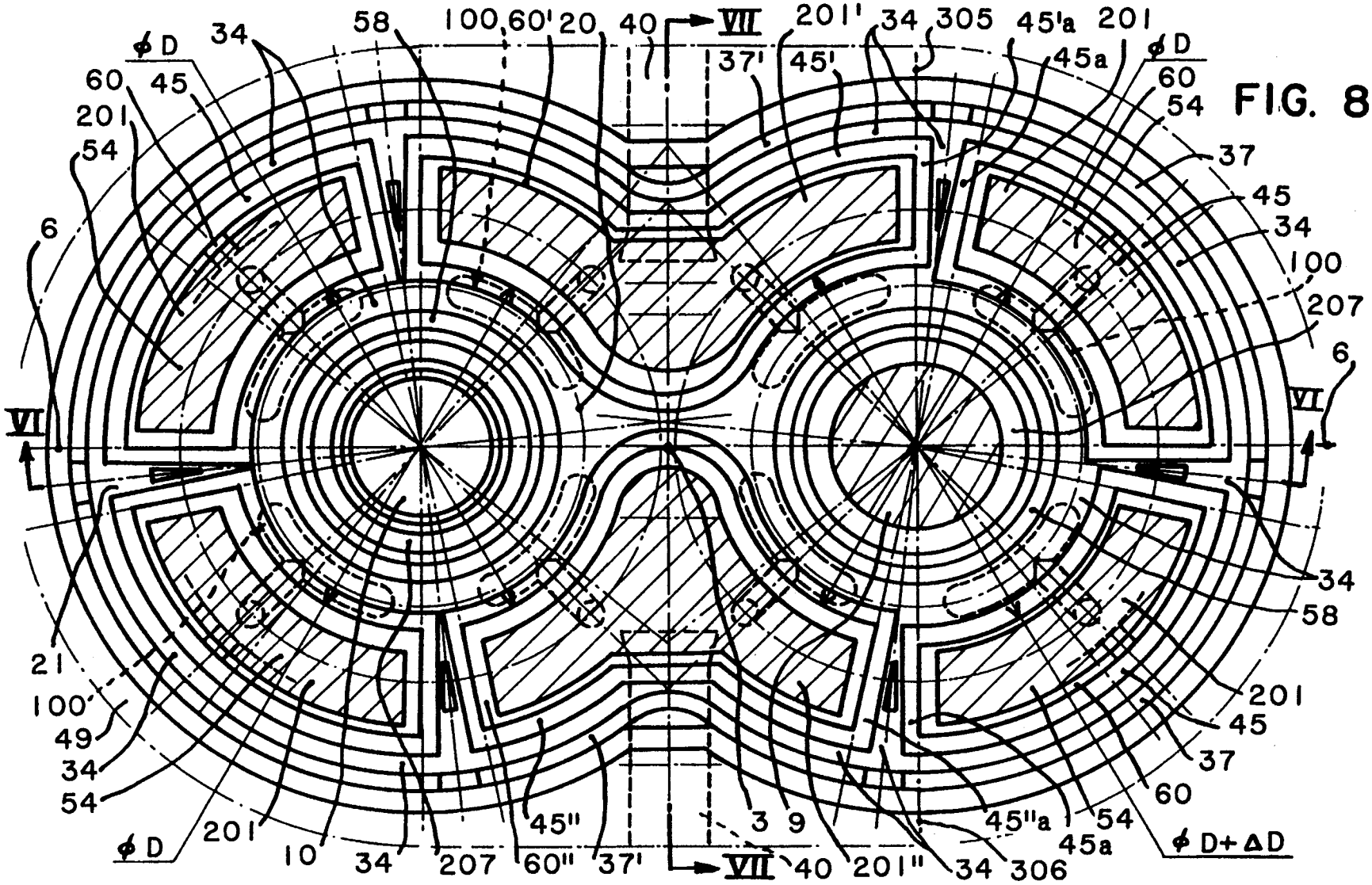
FIG. 8 is a section along VIII—VIII (FIG. 6) with axial balancing device. The plane of section of FIG. 6 is shown at VI—VI and that of FIG. 7 at VII—VII.

In a first solution illustrated in FIG. 8, the diameter D of the permanent total pressure zone 34 is increased by a value ΔD to become D +ΔD at the level of sectors 60' and 60 diametrally opposite each other on the driving gear 9 side, the sectors being disposed on the side plates 21, 22 while the dimensions of the sectors on the driven gear 10 side remain unchanged. The increase of ΔD gives an additional surface ΔS of the zone 34 so that ΔS=FA/HP. This arrangement produces a supplementary force (FA) on the side plate where the sectors 60 and 60' are at low pressure. This force, equal to FA, and of opposite direction, balances the driving gear 9 in the axial direction.

Figure 9:
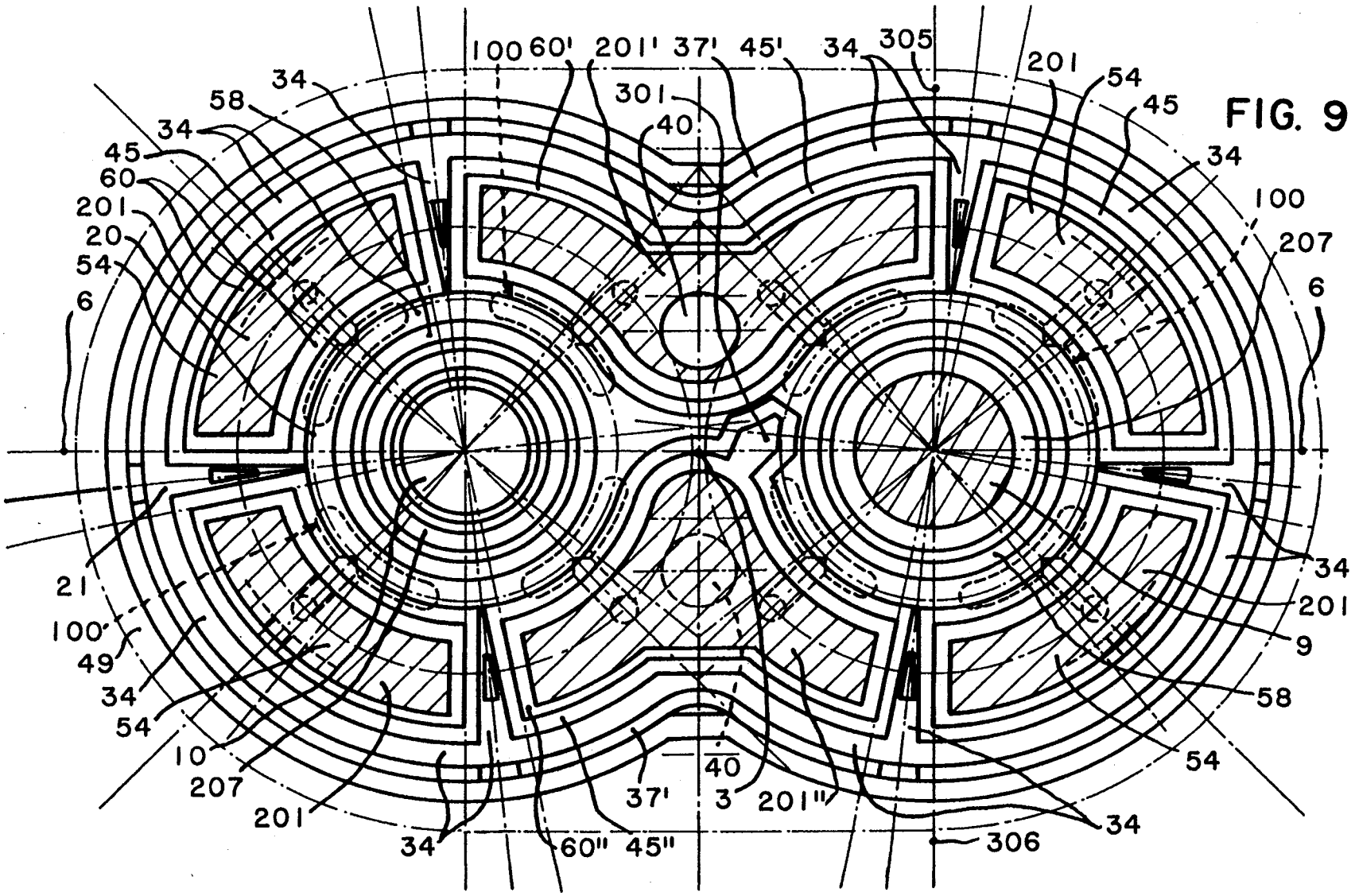
FIG. 9 is a variant of the axial balancing device of FIG. 8.

The solution illustrated in FIG. 9 consists in incorporating in the sector 60'' of the side plates 21, 22 an extension 301, to the detriment of permanent high pressure zone 34, of surface ΔS. The extension 301 is in the general form of a polygon surrounded by a deviation of the joint 45''.

This structure brings about the creation of a force perpendicular to the side plate in which the sector 60'' is at high pressure, the force being equal to the axial force FA further to the choice of the surface ΔS and of opposite direction. The counterforce −FA in question re-balances the driving gear 9.

The couple resulting from the distance separating the antagonistic force −FA and the axial force FA and whose value is $$M_{FA} = FA \times \frac{D_p}{2}$$

in the solution illustrated in FIG. 8 (in which $D_p$ is the diameter of the primitive circle of the toothing of the gear 9), is balanced by the reactions of the mechanical bearings 123 of the gear 9.

In the case of an apparatus with a plurality of driven satellite gears n, axial balancing of the driving gear 9 is effected in accordance with one of the two solutions hereinabove and the vector moments of the resulting couples are annulled. The additional re-balancing force is equal to the axial force FA per couple of gears 9, 10 multiplied by the number of satellites n.

Figure 1:
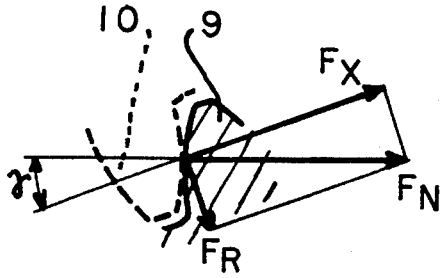
FIG. 1 illustrates the decomposition of the normal force FN into FR and FX perpendicular to FR at the mesh point of the gears 9 and 10.
Figure 3:
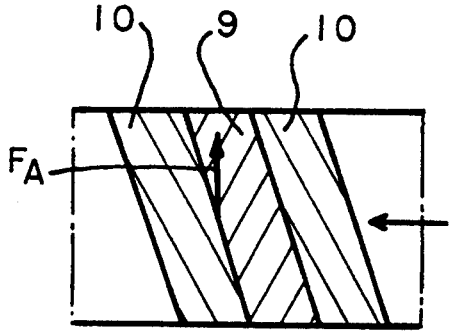
FIGS. 3 and 4 are developed sections along the pitch cylinders of the respectively driving and driven gears in meshed position, illustrating the direction of the axial component of disequilibrium of the driving gear, depending on the clockwise and anti-clockwise directions of rotation of the driving gear.
Figure 2:
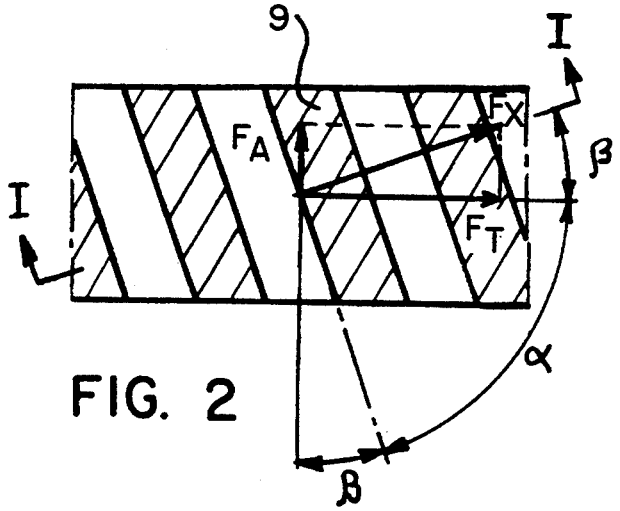
FIG. 2 is a developed section along the pitch cylinder of the driving gear. The plane of section of FIG. 1 has been shown at I—I.
Figure 4:
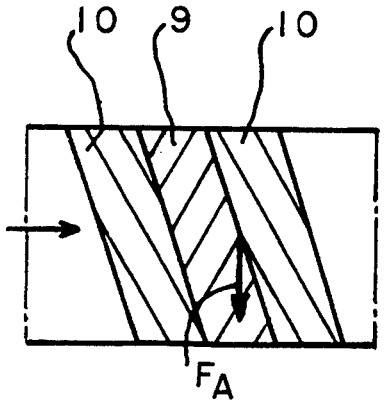
Figure 5:
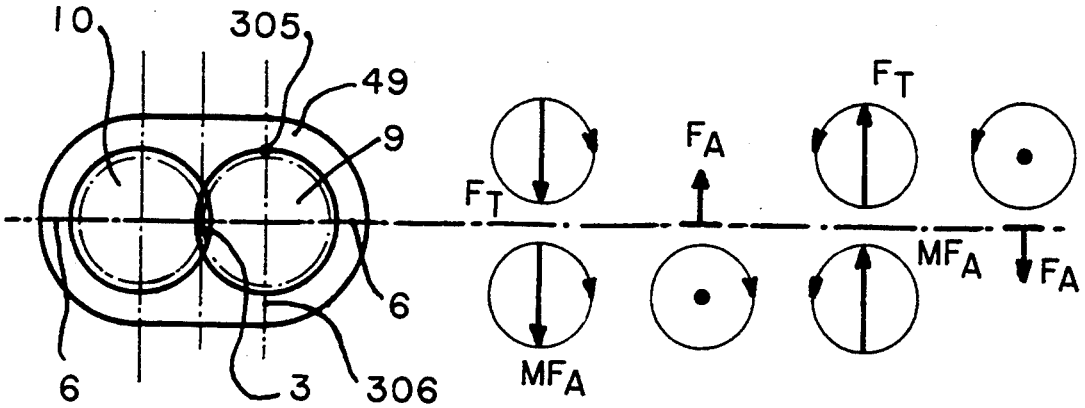
FIG. 5 illustrates the balance, depending on the direction of rotation, of the forces and the couples of disequilibrium of the driving gear of a generator-receiver with one driven gear.
Figure 6:
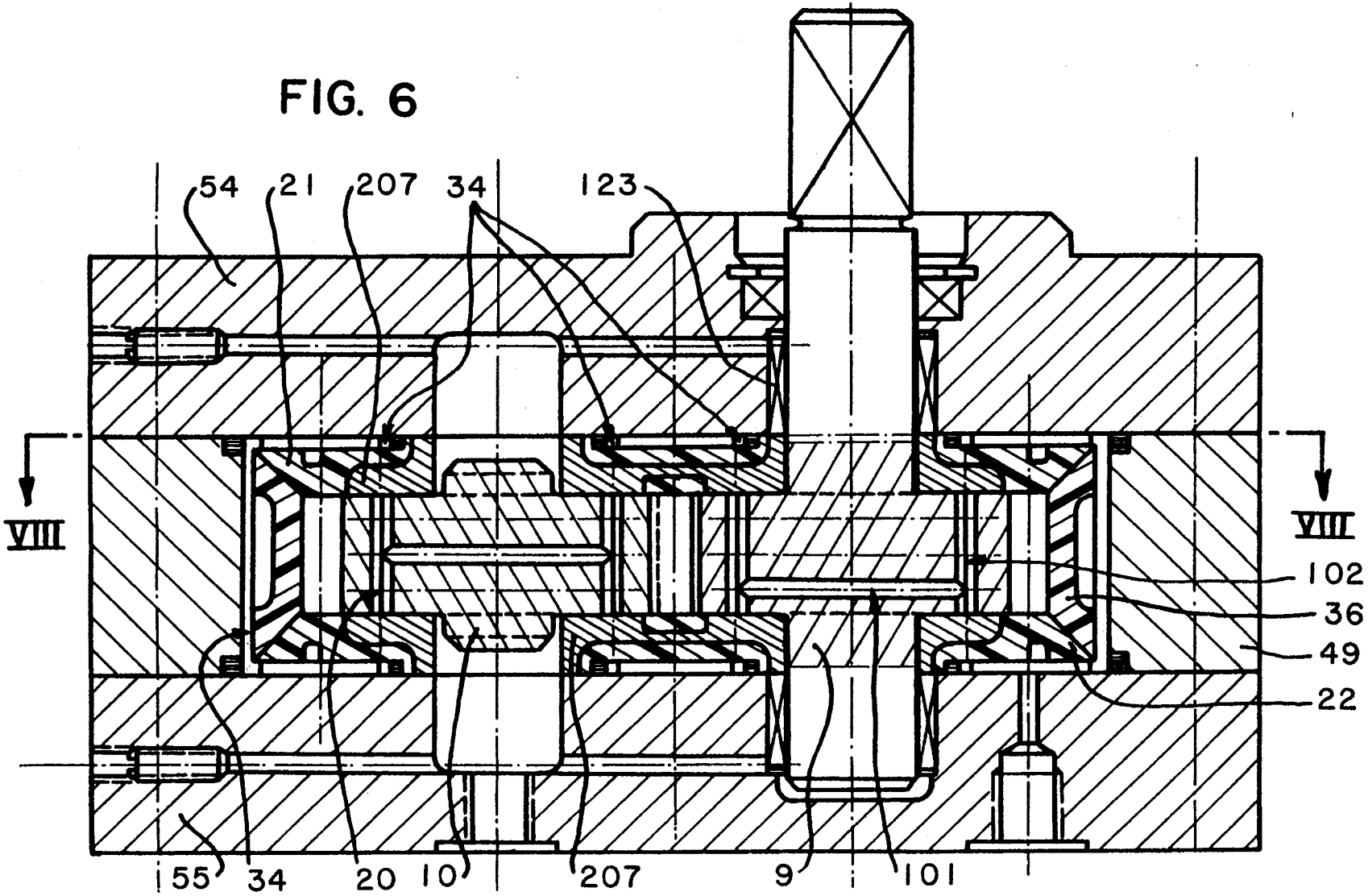
FIG. 6 is a longitudinal section of an apparatus according to the invention.
Figure 7:
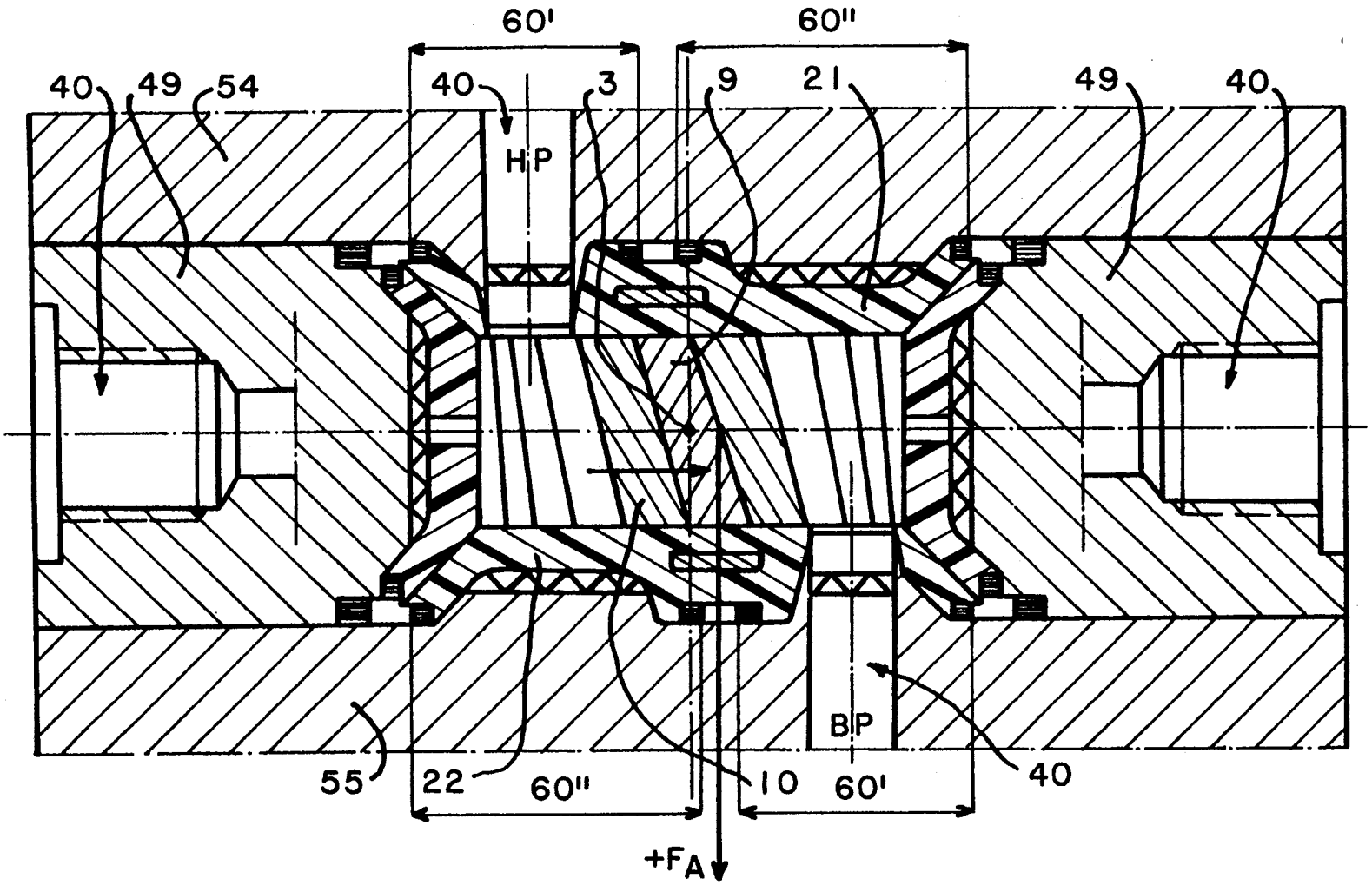
FIG. 7 is a transverse section through an apparatus according to the invention made along a plane passing through the mesh point of the gears.

FIG. 7 illustrates an apparatus according to the invention with one driven gear 10, the driving gear 9 being with left-hand helix. This gear is therefore located to the rear of the plane of section of the figure, while the driven gear 10 is located in front of said plane with right-hand helix.

Consequently, the axial force FA is directed downwardly, so that the counterforce −FA must be directed upwardly and in any case in the direction opposite to FA.

Consequently:

if zone 34 is increased, this increase reduces both diametrically the sector 60′ and diametrically opposite sector 60 (FIG. 8). This increase does not bring about any supplementary force on the side plate 21 on which sectors 60 and 60′ are at high pressure, while it creates the sought-after counterforce −FA on the opposite side plate 22 whose sectors 60 and 60′ are at low pressure.

In fact, on side plate 21, the increase in the surface of the zone 34, corresponding to a reduction in the surface of the sectors 60 and 60′ does not bring about any variation in the axial hydrostatic compensation force.

On the contrary, on the opposite side plate 22, the surface of its sectors 60 and 60′ subjected to low pressure having decreased and the surface of the zone 34 always at high pressure having increased, the counterforce −FA is created.

If the surface of zone 34 is reduced by increasing the surface of sector 60″ by the value of the extension 301 (FIG. 7), the counterforce −FA is created on the side plate 22 in which the sector 60″ is at high pressure since, on the side plate 21 in which the sector 60″ is at low pressure, the extension 301 is at low pressure, with the result that there is balancing.

If the pressures in the outputs 40 are reversed with respect to the indications of FIG. 7, the reasoning is the same due to the symmetry with respect to the mesh point of the gears 9, 10.

Figure 10:
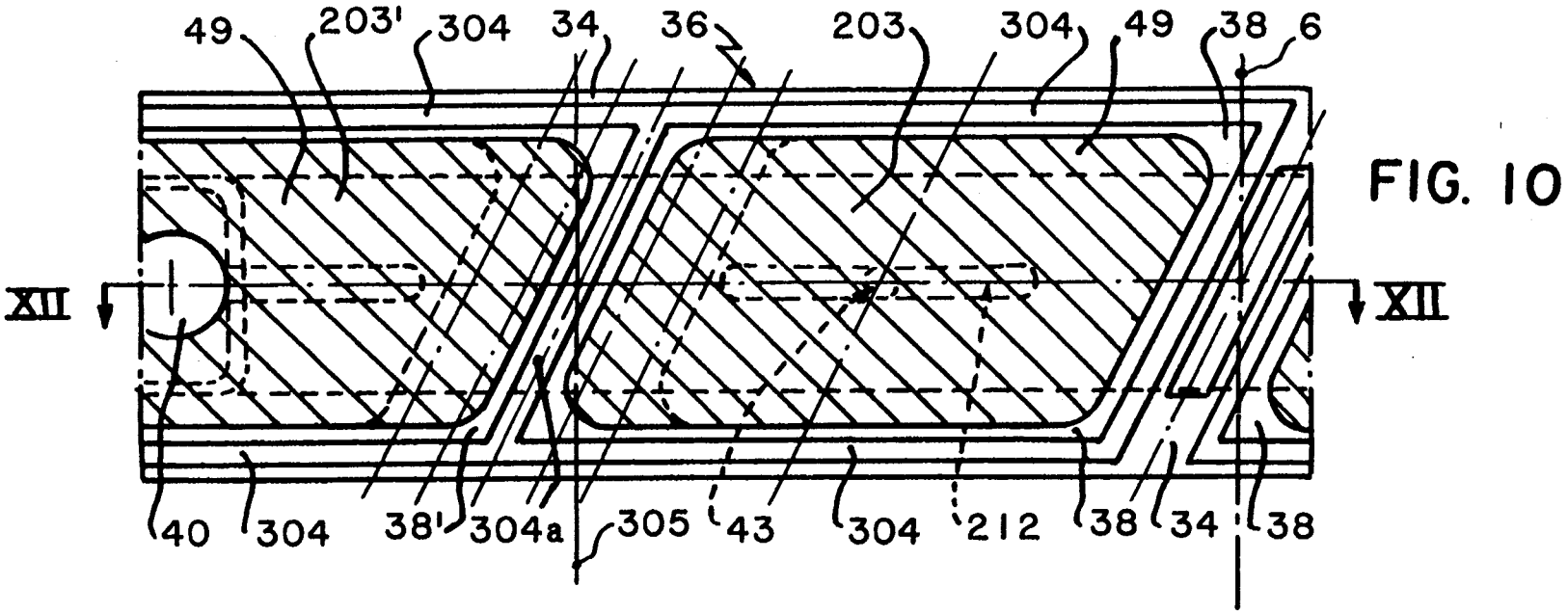
FIG. 10 is a partial developed section of the envelope and of the body in the case of a hydrostatic balancing on this envelope of the tangential component FT.
Figure 12:
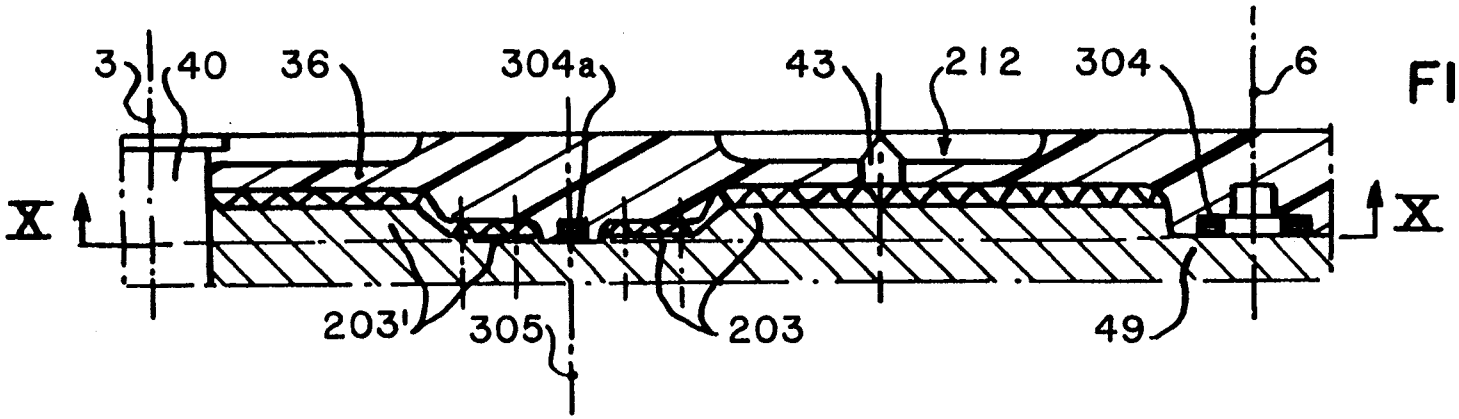
FIG. 12 is a section along XII—XII (FIG. 10). The plane of section of FIG. 10 is shown at X—X.
Figure 11:
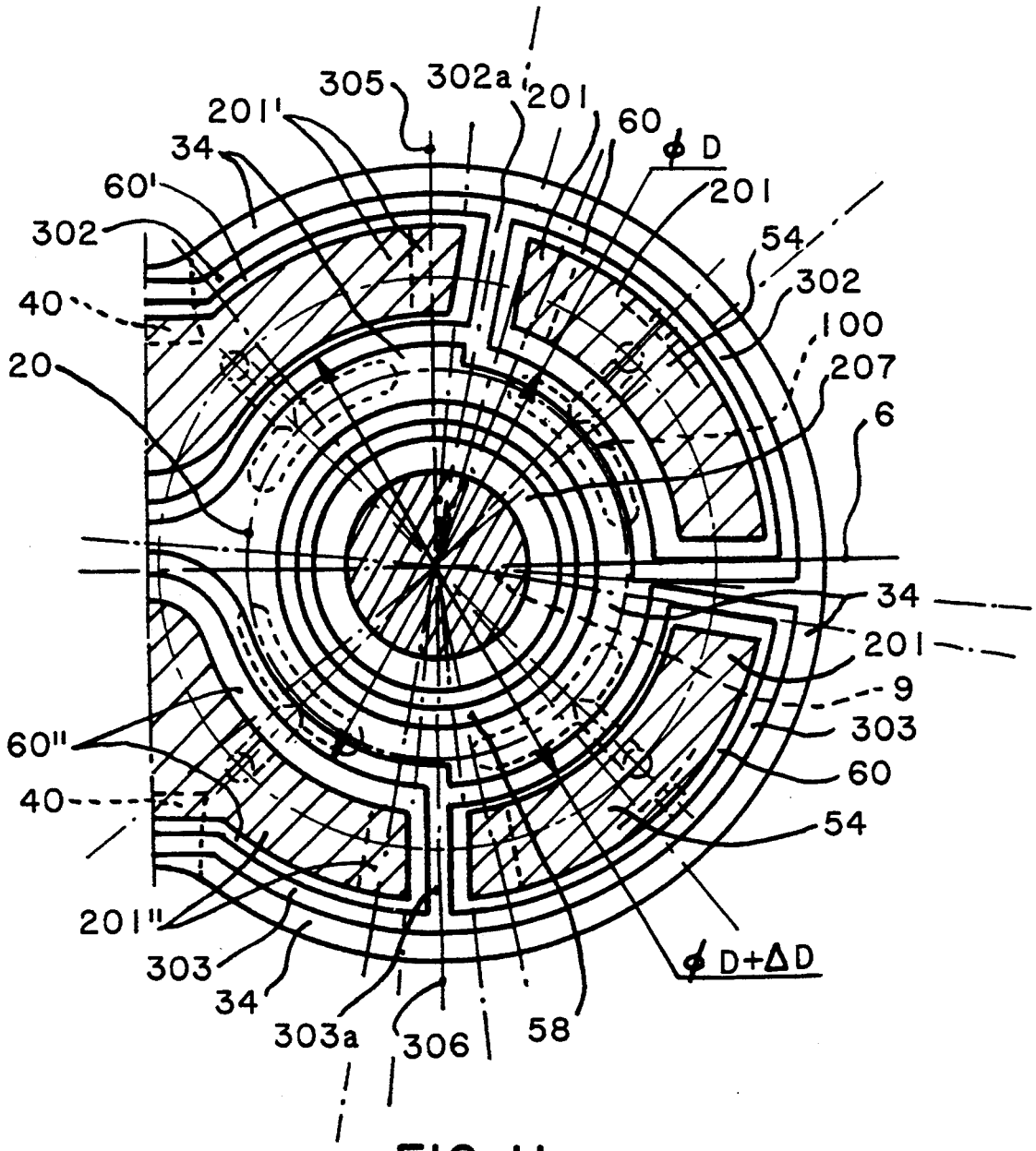
FIG. 11 is a partial section corresponding to FIGS. 8 and 9, but illustrating the modifications of the side plates corresponding to the real balancing on the envelope of the tangential component FT.

Hydrostatic balancing of the tangential force FT is effected by means illustrated in FIGS. 10, 11 and 12.

These means firstly consist, as shown in FIG. 10, in eliminating the zone 34 between the sectors 38′ and 38 adjacent the mesh point 3 of the gears at the level of the radii 305 and 306 of gear 9 perpendicular to axis 6—6. The joints 37′ and 37 provided in the embodiment of FIG. 9 of U.S. Pat. No. 5,178,528 are replaced by a single joint 304 provided with a median branch 304*a*. This median branch is located along the radii 305 and 306 illustrated in FIG. 11, as explained hereinbelow.

The above modification requires eliminating that part of the zone 34 between the sectors 60′, 60, respectively 60″, 60 of the side plates 21, 22 (FIG. 11) at the level of radii 305, 306, so that, for each of the radii, the radial parts 45*a*, 45′*a* of the joints 45 and 45″ symmetrical to the preceding ones with respect to the geometrical axis 6—6 are eliminated without influencing in any way the axial balancing.

As illustrated in FIG. 11, the sectors 60, 60′ and 60″, 60 are surrounded by one-piece joints 302 and 303 which each comprise respectively, along radii 305 and 306, a branch 302*a*, respectively 303*a*, which separates the sectors in question.

The branch 304*a* of the joint 304 on the envelope 36 materializing the end of that part of the zone 34 incorporated in the sectors 38′ for balancing the force FT, lies at a $\frac{1}{4}$ of angular tooth pitch from the axis of the "hydraulic bearing", or $\pi/2Z$. Consequently the component FT is balanced by this supplement of sector 38′ which is at high pressure for a value slightly greater than $\pi/Z$, i.e., $\pi/Z+\epsilon$. The value $\pi/Z+\epsilon$ incorporated in the sectors 38′ on the driving gear 9 side must be calculated to balance FT, taking into account the shift introduced by the width of the joint. The values on the side plates 21, 22 must correspond to the values on the envelope 36 in order to ensure sealing on the faces. These arrangements allow partial balancing of the force FT (due to the width of the joints) with total reversibility in clockwise and anti-clockwise directions, as generator and as receiver. Perfect balancing of the tangential force FT can be effected only with a priority direction of rotation, clockwise or counterclockwise, as a generator and as a receiver, due to the width of the joints. However, this slight imbalance may be considered as negligible.

In double-helical toothing, the tangential force FT is balanced under the same conditions as for a helical toothing, the only difference being that the joint 304 in that case presents, like sectors 38 and 38′, the form of double helices.

In the case of a generator-receiver with n driven satellite gears, the tangential forces FT are balanced naturally (closed polygon of the forces FT).

Figure 13:
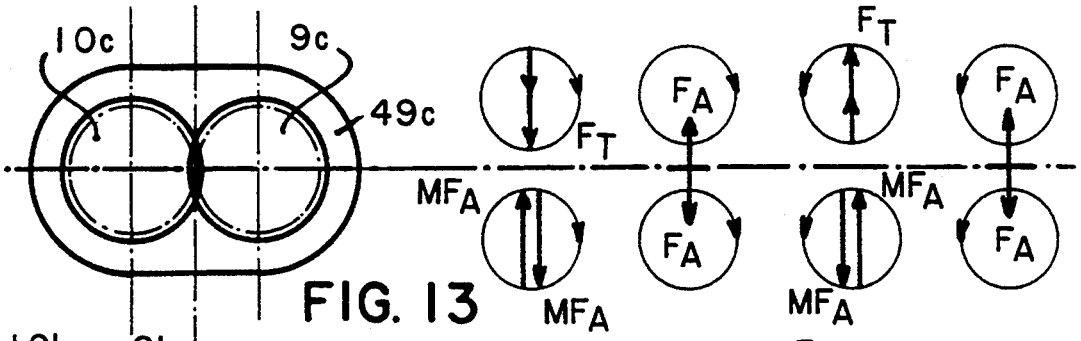
FIGS. 13 to 16 illustrate the polygon of equilibrium of the tangential components FT, of the vector couples MFA and the axial components FA to be balanced in the respective case of a generator-receiver with double helical toothing and with 2, 3, 4 satellite gears, and depending on the direction of rotation.

The above balancing arrangements are illustrated, concerning the generator-receivers with double-helical toothing and with one driven satellite gear, in FIG. 13, which shows the driving gear 9*c* and a satellite gear 10*c* in the body 49*c*, the forces FT per branch of chevrons to be balanced (hydrostatic balancing or reactions of the bearings 123), and the polygon of couple vectors MFA closed, the axial components per branch of chevrons being annulled (FA−FA=0).

Figure 14:
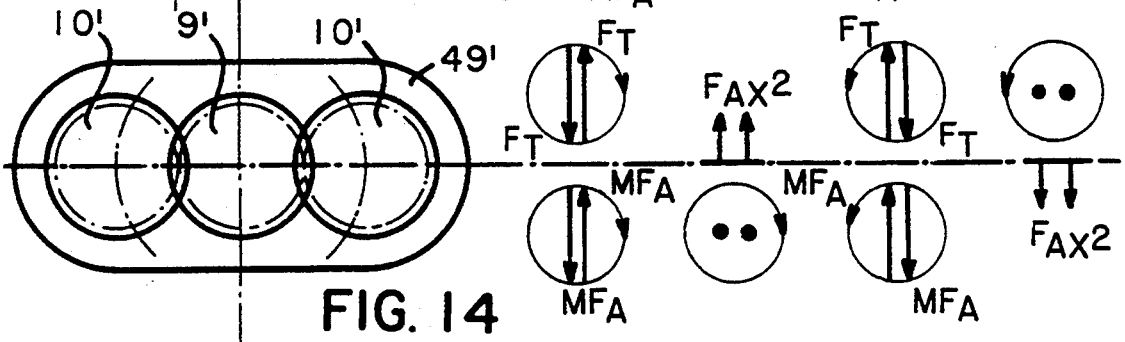
Figure 15:
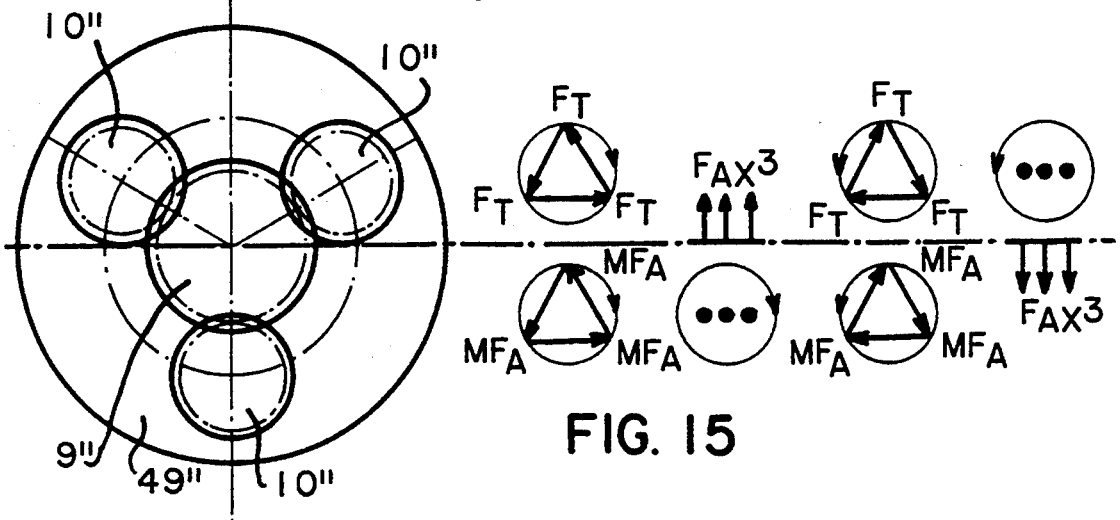
Figure 16:
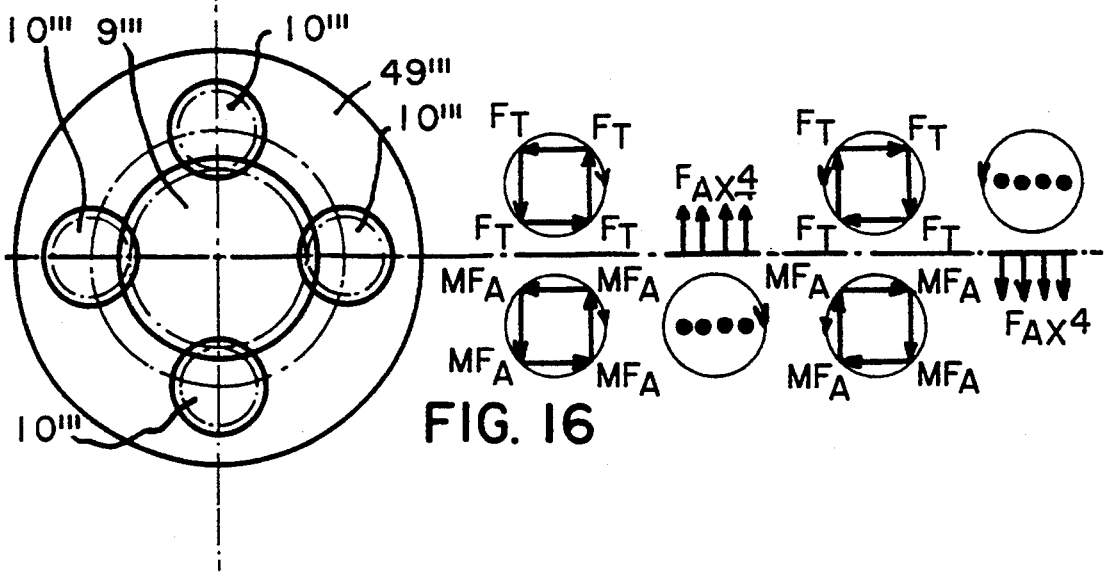

The same balancing arrangements are illustrated, concerning the generator-receivers with n driven satellite gears, in FIGS. 14, 15 and 16 in which they are schematized by the body 49 and the gears 9 and 10.

In FIG. 14, there are one gear 9′ and two satellite gears 10′ in a body 49′. The polygon of the forces FT is closed, the polygon of the couple vectors $M_{FA}$ is closed under the same conditions. The additional axial component on the gear 9′ is equal to twice FA per couple of gears 9′–10′.

FIG. 15 illustrates a driving gear 9″ and three satellite gears 10″ in a body 49″. The polygon of the forces FT is closed, like the polygon of the vector couples $M_{FA}$ under the same conditions. The additional axial component on gear 9″ is equal, in this case, to three times FA per couple of gears 9″–10″.

For FIG. 16 which shows a driving gear 9‴ and four satellite gears 10‴ in a body 49‴, the same applies i.e., the polygon of forces FT is closed, the polygon of the vector couples $M_{FA}$ is closed under the same conditions and the supplementary axial component on the gear 9‴ is equal to four times FA per couple of gears 9‴–10‴.

In conclusion, and taking into account the possibilities of balancing set. forth hereinabove, the following may be adopted:

for high speeds of rotation and low cubic capacities, a hydraulic generator-receiver with one satellite gear and one double-helical toothing, for average and low speeds of rotation with average and high cubic capacities, a hydraulic generator with a plurality of driven satellite gears n with balancing of the axial force of the driving gear 9.

A generator-receiver with one driven satellite gear and with helical toothing will be used only if this solution presents certain economic advantages, as it is less rational than the two preceding ones on the functional plane. Axial balancing will be necessary, balancing of the tangential force will depend on the conditions of use.

Figure 17:
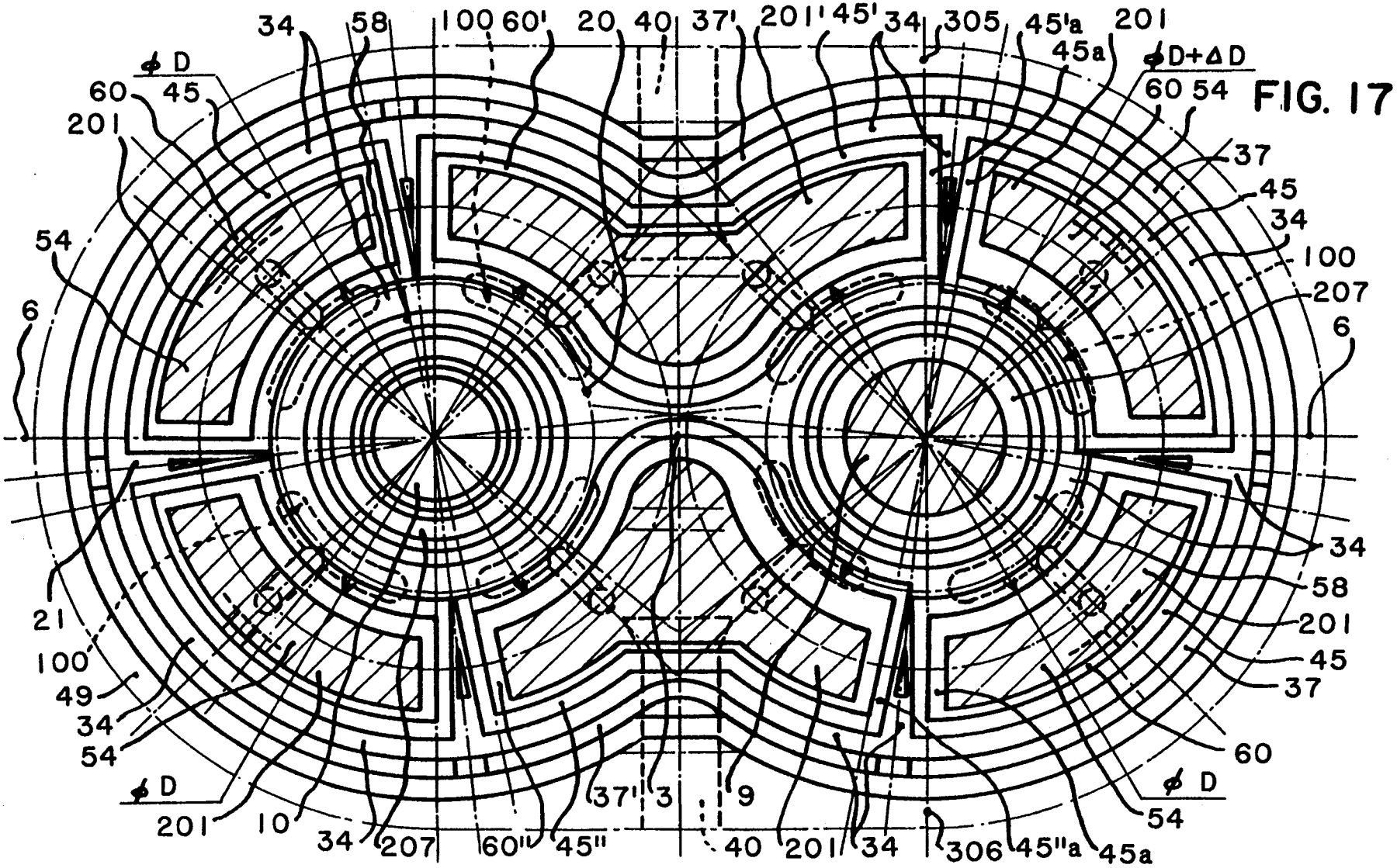
FIG. 17 is a variant of the axial balancing device illustrated in FIG. 8 and comparable to the variant of FIG. 9.

It must, moreover, be understood that the foregoing description has been given only by way of example and that it in no way limits the domain of the invention which would not be exceeded by replacing the details of execution described by any other equivalents. For example, in the solution illustrated in FIG. 17, the diameter D of the permanent total pressure zone 34 is reduced by a value $\Delta D$ to become $D-\Delta D$ at the level of sectors 60'' and 60 opposite each other on the driving gear 9 side, the sectors being disposed on the side plates 21, 22 while the dimensions of said sectors on the driven gear 10 side remain unchanged. The reduction of $\Delta D$ gives a surface of zone 34 reduced by $\Delta S$ so that $\Delta S=F/HP$. This arrangement brings about an increase in force $FA=HP \times \Delta S$ on the side plate where the sector 60'' is at high pressure which compensates FA as it is of opposite direction and balances the gear in the axial direction.

What is claimed is:

1. A hydraulic generator-receiver with gears with helical toothing composed of a driving gear unbalanced by an axial force (FA) and a tangential force (FT) and meshing with at least one free driven gear at a mesh point and always balanced, internal balancing being ensured by a hydraulic winding system creating hydraulic bearings, internal tightness being obtained by a flexible system composed of two side plates and an envelope with hydrostatic compensation by means of high and low pressure round-V-shaped and arcuate hydrostatic compensation sectors and a permanent high pressure zone having an area and a diameter (D) which surrounds said sectors, wherein axial hydrostatic balancing of the driving gear is obtained by the creation of a counterforce (−FA) to said axial force (FA) by increasing the area of said permanent high pressure zone (34) on said side plates by increasing said diameter D of said zone, where said zone is adjacent two diametrically opposite said rounded-V-shaped and arcuate hydrostatic compensation sectors (60,60'), the area of said sectors reducing accordingly, giving a force whose effect materializes on the side plate where said sectors are under low pressure.

2. A hydraulic generator-receiver with gears with helical toothing composed of a driving gear unbalanced by an axial force (FA) and a tangential force (FT) and meshing with at least one free driven gear at a mesh point and always balanced, internal balancing being ensured by a hydraulic winding system creating hydraulic bearings, internal tightness being obtained by a flexible system composed of two side plates and an envelope with hydrostatic compensation by means of high and low pressure rounded-V-shaped and arcuate hydrostatic compensation sectors and a permanent high pressure zone having an area and a diameter (D) which surrounds said sectors, wherein said axial hydrostatic balancing of said driving gear is obtained by means of a counterforce (−FA) to the axial force (FA), said counterforce (−FA) being created by a reduction of said area of said permanent high pressure zone on said side plates by increasing, by an extension (301) of said area, one (60'') of said rounded-V-shaped hydrostatic compensation sectors, giving a force whose effect materializes only on said side plate where said sector (60'') is at high pressure.

3. A hydraulic generator-receiver with gears with helical toothing composed of a driving gear unbalanced by an axial force (FA) and a tangential force (FT) and meshing with at least one free driven gear at a mesh point and always balanced, internal balancing being ensured by a hydraulic winding system creating hydraulic bearings, internal tightness being obtained by a flexible system composed of two side plates and an envelope with hydrostatic compensation by means of high and low pressure rounded-V-shaped and arcuate hydrostatic compensation sectors and a permanent high pressure zone having an area and a diameter (D) which surrounds said sectors, wherein hydrostatic balancing of said tangential force (FT) acting on said driving gear is obtained by the formation of a counterforce to said tangential force (FT) and equal thereto, created by increasing said area of said sectors (38') of said envelope (36) on said driving gear side, and by increasing said area of said hydrostatic compensation sectors (60', 60'') on said side plates (21, 22).

4. Generator-receiver according to claim 3, wherein said increase of said area of said hydrostatic sectors is made by eliminating the part of said zone (34) between said sectors (60', 60−60'', 60['']) , of said side plates (21, 22), respectively.

5. Generator-receiver according to claim 4, wherein said sectors (60', 60−60'', 60) are surrounded by one-piece joints (302, 303) having a branch (**302*a*) separating said sectors (60', 60−60'', 60**).

6. A hydraulic generator-receiver with gears with helical toothing composed of a driving gear unbalanced by an axial force (FA) and a tangential force (FT) and meshing with at least one free driven gear at a mesh point and always balanced, internal balancing, being ensured by a hydraulic winding system creating hydraulic bearings, internal tightness being obtained by a flexible system composed of two side plates and an envelope with hydrostatic compensation by means of high and low pressure rounded-V-shaped and arcuate hydrostatic compensation sectors and a permanent high pressure zone having an area and a diameter (D) which surrounds said sectors, wherein said axial hydrostatic balancing of said driving gear is obtained by means of a counterforce (−FA) to said axial component (FA), created by a reduction of said area of said permanent high pressure zone on said side plates by a reduction of said diameter (D), corresponding to an enlargement of said area of said diametrically opposite (60'', 60) rounded-V-shaped and arcuate hydrostatic compensation sectors, giving a force whose effect materializes only on the side plate where said sectors (60'', 60) are at high pressure.

7. A hydraulic generator-receiver with gears with helical toothing composed of a driving gear unbalanced by an axial force (FA) and a tangential force (FT) and meshing with at least one free driven gear at a mesh point and always balanced, internal balancing being ensured by a hydraulic winding system creating hydraulic bearings, internal tightness being obtained by a flexible system composed of two side plates and an envelope with hydrostatic compensation by means of high and low pressure rounded-V-shaped and arcuate hydrostatic compensation sectors and a permanent high pressure zone having an area and a diameter (D) which surrounds said sectors, wherein axial hydrostatic balancing of the driving gear is obtained by the creation of a counterforce (−FA) to said axial force (FA) by increasing the area of said permanent high pressure zone (34) on said side plates by increasing said diameter (D) of said zone, where said zone is adjacent two diametrically opposite said rounded-V-shaped and arcuate hydrostatic compensation sectors (60, 60'), the area of said sectors reducing accordingly, giving a force whose effect materializes on the side plate where said sectors are under low pressure, wherein hydrostatic balancing of said tangential force (FT) acting on said driving gear is obtained by the formation of a counterforce to said tangential component FT and equal thereto, created by increasing said area of said sectors (38') of said envelope (36) on said driving gear side, and by increasing said area of said hydrostatic compensation sectors (60', 60'') on said side plates (21, 22).

8. A hydraulic generator-receiver with gears with helical toothing composed of a driving gear unbalanced by an axial force (FA) and a tangential force (FT) and meshing with at least one free driven gear at a mesh point and always balanced, internal balancing being ensured by a hydraulic winding system creating hydraulic bearings, internal tightness being obtained by a flexible system composed of two side plates and an envelope with hydrostatic compensation by means of high and low pressure rounded-V-shaped and arcuate hydrostatic compensation sectors and a permanent high pressure zone having an area and a diameter (D) which surrounds said sectors, wherein said axial hydrostatic balancing of said driving gear is obtained by means of a counterforce (−FA) to the axial component (FA), said counterforce (FA) being created by a reduction of said area of said permanent high pressure zone on said side plates by increasing, by an extension (301) of said area, of one (60'') of said rounded-V-shaped hydrostatic compensation sectors, giving a force whose effect materializes only on said side plate where said sector (60'') is at high pressure, wherein hydrostatic balancing of said tangential force (FT) acting on said driving gear is obtained by the formation of a counterforce to said tangential force (FT) and equal thereto, created by increasing said area of said sectors (38') of said envelope (36) on said driving gear side, and by increasing said area of said hydrostatic compensation sectors (60', 60'') on said side plates (21, 22).

9. A hydraulic generator-receiver with gears with helical toothing composed of a driving gear unbalanced by an axial force (FA) and a tangential force (FT) and meshing with at least one free driven gear at a mesh point and always balanced, internal balancing being ensured by a hydraulic winding system creating hydraulic bearings, internal tightness being obtained by a flexible system composed of two side plates and an envelope with hydrostatic compensation by means of high and low pressure rounded-V-shaped and arcuate hydrostatic compensation sectors and a permanent high pressure zone having an area and a diameter (D) which surrounds said sectors, wherein said axial hydrostatic balancing of said driving gear is obtained by means of a counterforce (−FA) to said axial component (FA), created by a reduction of said area of said permanent high pressure zone on said side plates by a reduction of said diameter (D), corresponding to an enlargement of said area of said diametrically opposite (60'', 60) rounded-V-shaped and arcuate hydrostatic compensation sectors, giving a force whose effect materializes only on the side plate where said sectors (60'', 60) are at high pressure, wherein hydrostatic balancing of said tangential force (FT) acting on said driving gear is obtained by the formation of a counterforce to said tangential component (FT) and equal thereto, created by increasing said area of said sectors (38') of said envelope (36) on said driving gear side, and by increasing said area of said hydrostatic compensation sectors (60', 60'') on said side plates (21, 22).

* * * * *